US005983886A

United States Patent [19]

Allbeck

[11] Patent Number: 5,983,886

[45] Date of Patent: Nov. 16, 1999

[54] STORAGE CONTAINER FOR RAILROAD RACK HEATING CORD

[76] Inventor: Pat Monroe Allbeck, 1908 Grit Rd., Hurt, Va. 24563

[21] Appl. No.: 09/047,928

[22] Filed: Mar. 26, 1998

Related U.S. Application Data

[60] Provisional application No. 60/041,387, Mar. 26, 1997.

[51] Int. Cl.[6] ..... F23C 5/00

[52] U.S. Cl. ..... 126/271.2 B; 126/271.2 R; 431/316

[58] Field of Search ..... 431/315–318; 126/271.2 R, 271.2 B, 271.1

[56] References Cited

U.S. PATENT DOCUMENTS

| | | | |
|---|---|---|---|
| 829,824 | 8/1906 | Zicha | 431/316 |
| 1,148,413 | 7/1915 | Standridge | 431/316 |
| 2,530,473 | 11/1950 | Lebus | 126/271.2 B |
| 2,585,648 | 2/1952 | Greenfield | 126/271.2 B |
| 3,003,547 | 10/1961 | Tiedt | 126/271.2 B |

*Primary Examiner*—James C. Yeung
*Attorney, Agent, or Firm*—Jones, Tullar & Cooper, P.C.

[57] ABSTRACT

A storage container is used to hold a volume of a flammable liquid and a length of a cord that will be coated with the liquid, laid along a railroad rail, and ignited to heat the rail. The storage container is a closed receptacle that includes a cord drive assembly. The cord is pulled into the container using the drive assembly. Removal of the cord can be accomplished manually or by use of the cord drive.

18 Claims, 2 Drawing Sheets

FIG. 1
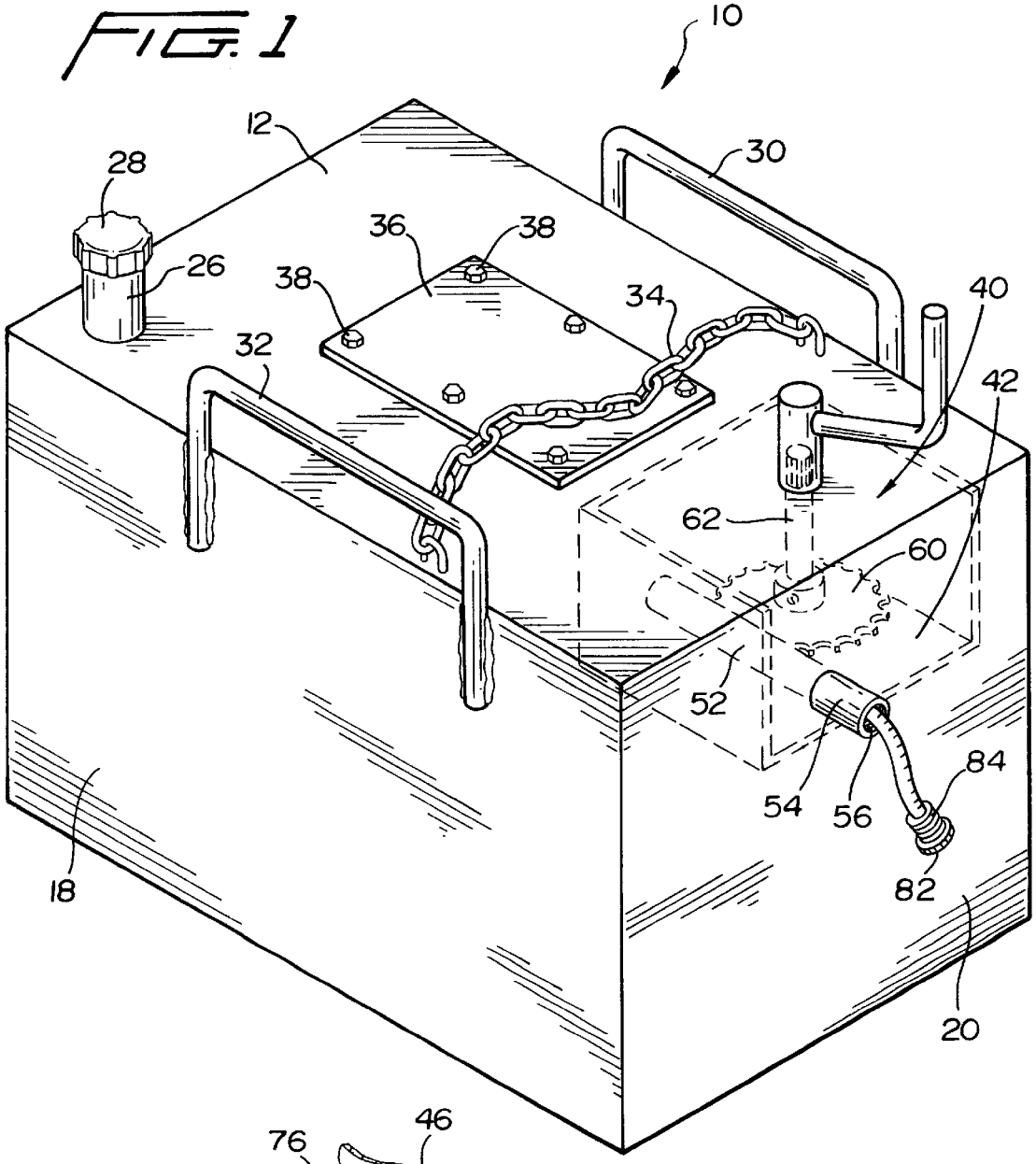
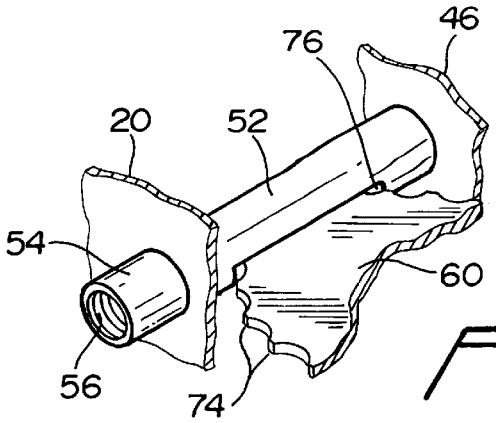
FIG. 4

STORAGE CONTAINER FOR RAILROAD RACK HEATING CORD

CROSS-REFERENCE TO RELATED APPLICATION

The subject patent application claims the benefit of U.S. provisional Application Ser. No. 60/041,387, which was filed on Mar. 26, 1997. The disclosure of that provisional patent application is hereby incorporated herein by reference.

FIELD OF THE INVENTION

The present invention is directed generally to a storage container for railroad track heating cord. More particularly, the present invention is directed to a storage container and flammable liquid container for a railroad track heating cord. Most specifically, the subject invention is directed to a flammable liquid storage container and immersion receptacle for a railroad track heating cord. The container is useable to provide a reservoir for a supply of flammable liquid, such as diesel fuel, into which a length of a flexible cord is placed. The container facilitates the placement of the cord into the liquid in the container, the storage of the cord in the liquid in the container, and the removal of the cord, which has been saturated with the flammable liquid, all in a safe manner.

DESCRIPTION OF THE PRIOR ART

The rails which are used to form railroad tracks are often installed in essentially continuous lengths with few, if any, junctures. This type of continuous rail arrangement is able to provide a smooth rail which is free of joints that will cause an unpleasant or rough ride. The rails are typically made of suitable steel which is intended to have long-wearing, high-strength characteristics.

As will be appreciated, there is little tolerance for rail expansion or contraction due to temperative fluctuations. Such dimensional changes will be apt to adversely affect the gauge or the spacing between the rails. Any large fluctuation in rail spacing can lead to derailments. Accordingly, the rails are laid quite precisely and are not expected to shift or move.

Inevitably a rail section will break. Such breakages often occur during periods of low temperature as a result of thermally induced contraction or skrinkage of the steel rail. When such a break occurs, the two ends of the broken rail will separate from each other. The repair of such a break and rail separation must be accomplished quickly and correctly since the track cannot be used until the necessary repairs have been accomplished.

A repair can be effected only after the two ends of the broken rail have been brought back together. The insertion of a length of rail in the gap between the two separated ends is not an acceptable repair. When the ambient temperature rises, the rail will expand and will distort due to the addition of the insert piece. Localized heating of the rails adjacent the break is not an acceptable solution since it will not cause the rails to "grow" or expand sufficiently to close the gap and will damage the rail ends. The only effective solution is to heat the rails to a length of 50 feet or more on either side of the break. This will raise the temperature of the rails sufficiently on either side of the break to allow the rail sections to expand or lengthen sufficiently for the gap to close; thereby, allowing the rail segments to be reunited by suitable means.

Various methods have been used to heat a length of rail on either side of the break. At one time, a mixture of sawdust and diesel fuel was laid along the track and was ignited. This procedure was replaced by using a hemp or other natural fiber rope immersed in diesel fuel and then laying it along the rail. Subsequently, the natural fiber rope was replaced by a synthetic rope or cord which could still hold a supply of a flammable liquid, such as diesel fuel, and which could be reused.

The rope or cord used as the rail heater has typically been saturated in diesel fuel simply by immersing it in a container, such as a five-gallon pail holding several gallons of diesel fuel. As will be readily apparent, such a practice has a high potential for disaster. The open pail filled with cord and diesel fuel can easily upset during transport to a point of usage. The removal of the saturated cord from the open pail will often result in spillage of diesel fuel onto the clothing of the track repair crew. Too many workers have been seriously burned when the track heating cord has been ignited and the flames have spread to the worker's clothes. At least, the spillage of several gallons of diesel fuel will result in unwanted environmental damage.

It will be seen that a need exists for a container for railroad track heating cord or rope which overcomes the limitations of the prior art. The storage container for railroad track heating cord in accordance with the present invention provides such a device and significant improvement over the prior art.

SUMMARY OF THE INVENTION

It is an object of the present invention to provide a storage container for railroad track heating cord.

Another object of the present invention is to provide a storage container for a flammable liquid used to immerse a railroad track heating cord.

A further object of the present invention is to provide a closed railroad track heating cord retraining container that is provided with a cord-feeding assembly.

Still another object of the present invention is to provide a railroad track heating cord storage container that is portable and spill-resistant.

Ever yet a further object of the present invention is to provide a storage container which facilitates removal of the flammable liquid-saturated cord with minimal spillage of the flammable liquid.

As will be discussed in greater detail in the description of the preferred embodiment, which is presented subsequently, the storage container for a railroad track heating cord in accordance with the present invention is generally in the nature of a closed container. This container is of sufficient size to hold approximately five gallons of a flammable liquid, such as diesel fuel. The liquid fills only approximately one-fifth of the volume of the container which is provided with a wide, flat base. A rope or cord drive is located within the container and is preferably attached to the upper portion of the container. This cord drive utilized a cord guide tube that extends from the exterior of the container to its interior. A cord drive sprocket is supported in the cord drive assembly and projects through a slot in the wall of the cord guide tube into the interior of the cord guide tube. A drive handle is used to rotate the sprocket whose teeth will engage the cord to thereby pull the cord into the container where it will fall to the bottom so that it can become saturated with diesel fuel. The end of the rope or cord is secured to a cord cap to prevent the end of the cord from being drawn into the container. This cord cap also closes the cord guide tube. The storage container is also provided with a fill tube and cap, handles, a lift chain, and an inspection plate.

The storage container for railroad track heating cord in accordance with the present invention provides a strong, durable container for the cord and for the diesel fuel within which it is immersed. The container will withstand rough handling and does not allow the diesel fuel to be spilled. The container is easily placed in the bed of a pickup truck or a similar light utility vehicle.

When the track heating cord is to be used, the storage container can be situated adjacent the track. The liquid saturated cord can be pulled out of the container, through the cord guide tube and can be positioned along the track. Such removal of the cord from the container will result in virtually no spillage of the flammable liquid. Once the storage container has been moved away to a safe distance, the cord can be ignited. After the flammable liquid has burned off and the cord has cooled, it can be returned back into the box by insertion of the cord into the cord guide tube and by rotation of the cord drive sprocket through actuation of the sprocket drive handle. After the cord has been pulled back into the container, the cord cap can be secured to the outer end of the cord guide tube thus closing the container.

The storage container for railroad track heating cord in accordance with the present invention overcomes the limitations of the prior art. It is rugged, resists spillage, keeps flammable liquid contained, and eliminates possible environmentally damaging spills. It is a substantial advance in the art.

BRIEF DESCRIPTION OF THE DRAWINGS

While the novel features of the storage container for railroad track heating cord in accordance with the present invention are set forth with particularly in the appended claims, a full and complete understanding of the invention may be had by referring to the detailed description of the preferred embodiment, as presented subsequently, and as illustrated in the accompanying drawings, in which:

FIG. 1 is a perspective view of a storage container for railroad track heating cord in accordance with the present invention;

FIG. 4 is a perspective view of a portion of the cord drive assembly of the present invention.

DESCRIPTION OF THE PREFERRED EMBODIMENT

Figure 2:
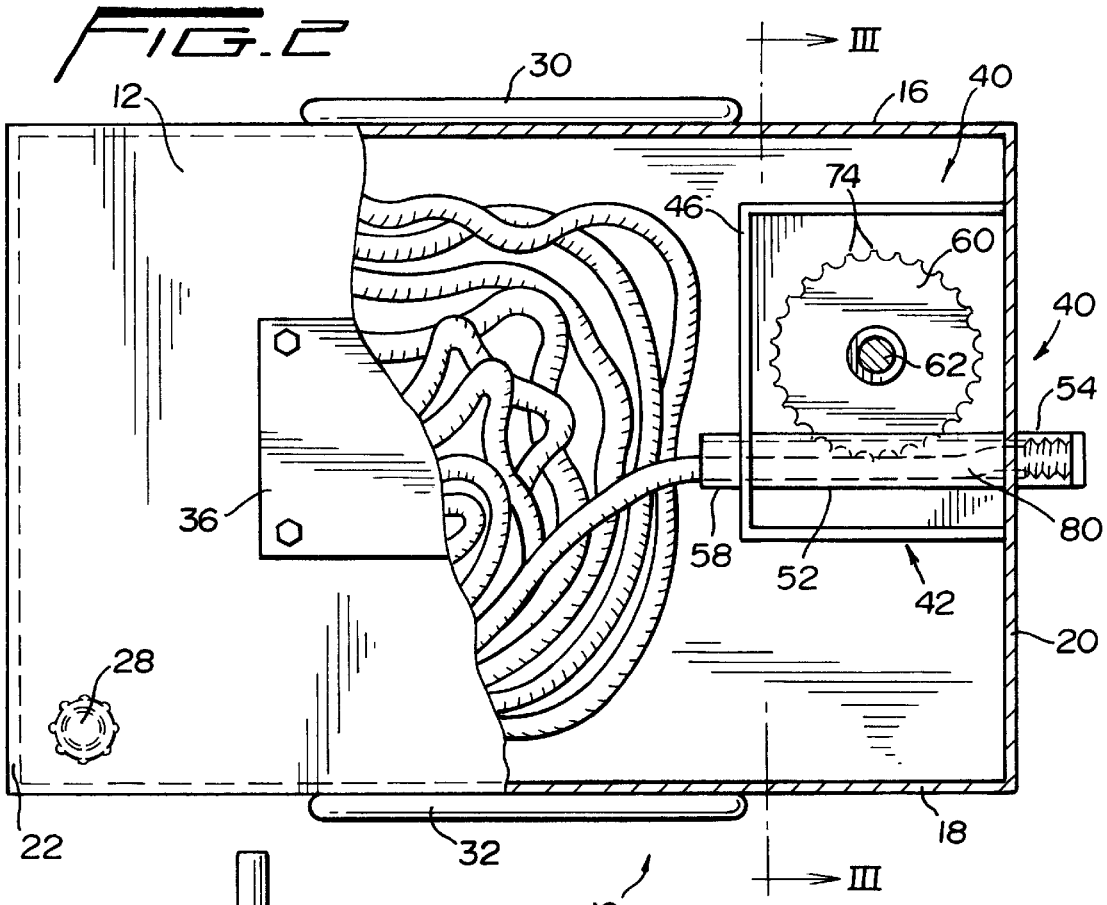
FIG. 2 is a top plan view of the storage container with a portion of the top wall removed for ease of illustration.
Figure 3:
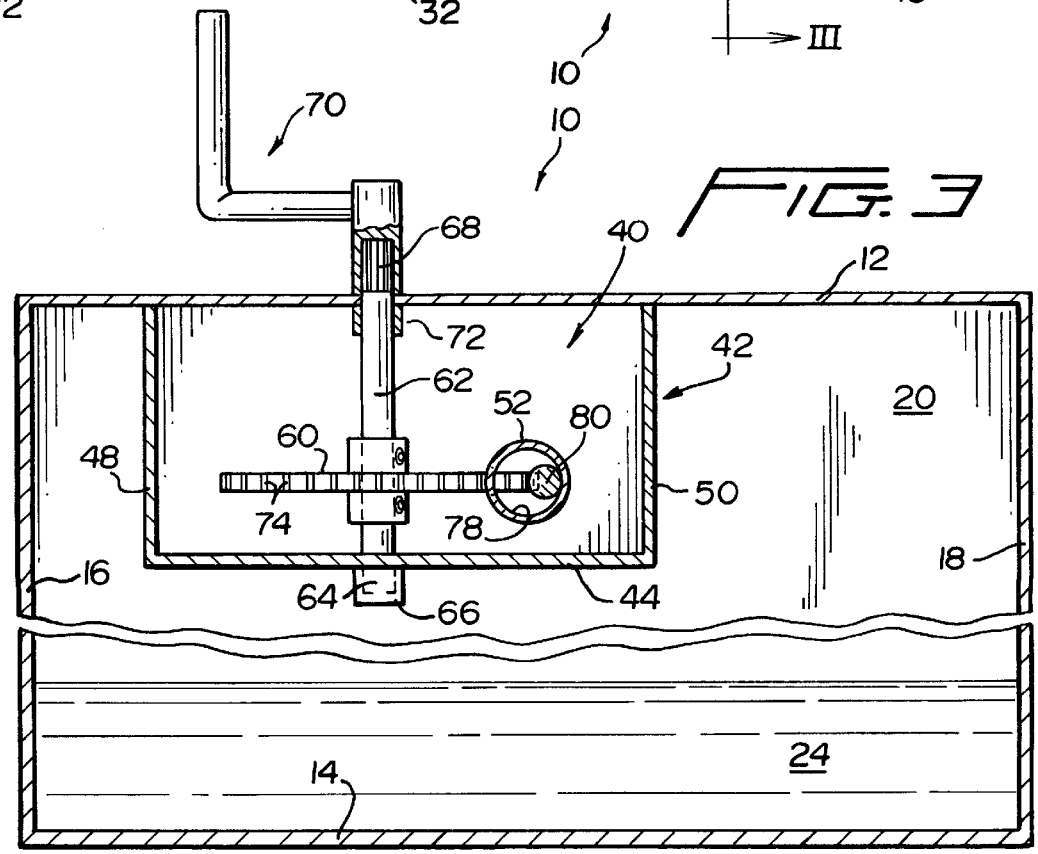
FIG. 3 is a cross-sectional view of the storage container taken along line III—III of FIG. 2.

Referring initially primarily to FIG. 1, there may be seen, generally at 10, a preferred embodiment of a storage container for railroad track heating cord in accordance with the present invention. As is shown in FIGS. 1, 2, and 3, storage container 10 is a generally rectangular receptacle that is defined by a top wall 12, a bottom 14, side walls 16 and 18, and end walls 20 and 22. In its preferred embodiment, the storage container 10 is made from a suitable steel or other similar material and is assembled by welding or otherwise to form a sturdy, durable liquid-tight receptacle. Preferably the storage container is 24 inches long, 16 inches wide and 16 inches high. The container defines a hollow interior space that can receive an amount of a flammable liquid, such as diesel fuel, designated generally at 24 in FIG. 3. It will be seen that five gallons of such diesel fuel 24 will occupy substantially less that ½ of the interior volume of the storage container 10. A suitable liquid fill spout or neck 26 is welded or otherwise attached to the top 12 of the storage container 10. A suitable fill spout closure cap 28 is removably securable to the open top of the fill neck 26. If desired, the fill neck 26 and the cap 28 can be provided with cooperating threads. Other styles of filler spout closure caps could be provided instead of the cap 28 depicted, and it will be understood that cap 28 is exemplary of these various caps.

A pair of handles 30 and 32 are secured to the side walls 16 and 18 of the storage container 10. These handles 30 and 32 are generally in the shape of inverted U-shaped metal rods or bars which are attached to side walls 16 and 18 by welding. A lifting chain 34 is attached to the top 12 of the storage container 10 by welding of ends of chain 34 to the storage container top 12 generally adjacent the handles 30 and 32. This lifting chain 34 could be provided with a central lifting eye, if desired. It could also be a lifting cable or strap instead of a chain. The purpose of both lifting handles 30 and 32 and the lifting chain 34 or similar step is to facilitate the lifting, transport, handling, and securement of the storage container 10 that may be relatively heavy due to its rugged steel construction and the weight of the five gallons of diesel fuel that it may contain.

An access and inspection plate 36 is attached to the top 12 of the storage container 10 such as by suitable bolts 38. This access and inspection plate 36 can be removed by removal of the bolts 38 to provide access to the interior of the container 10. Such access may be necessary periodically.

A cord drive assembly, generally at 40, as seen in FIGS. 1, 2, and 3, is secured within the interior of the storage container 10, generally adjacent the top wall 12 and one end wall 20 of storage container 10. The cord drive assembly 40 is situated within a cord drive enclosure 42 formed by an enclosure base 44, an enclosure end wall 46, and enclosure sides 48 and 50. These cooperate with the container top 12 and the storage container end wall 20 to form the cord drive assembly enclosure 42, which may be liquid-tight, if desired. Alternatively, the enclosure end wall 46 can be omitted, thus providing an open enclosure 42.

A cord guide tube 52 is secured within the cord drive assembly enclosure 42 and extends from the container end wall 20 to the drive enclosure end wall 46. If this end wall 46 is omitted, the cord guide tube 52 can be secured to the enclosure side wall 50 by welding or the like. This cord guide tube 52 is a length of 1¼ inch diameter, schedule 40 pipe and in the preferred embodiment is 9 inches long. An outboard end 54 either interior or exterior for engagement with a cord cap, as will be discussed shortly. An inboard end 56 of the cord guide tube 52 can end flush with the enclosure end wall 46 or can extend for a short distance into the interior of the storage container, as shown in FIG. 2.

A cord drive sprocket 60 is supported for rotation in the cord drive assembly enclosure 42 by a sprocket shaft 62. Shaft 62 is oriented generally vertically, as seen most clearly in FIGS. 1 and 3. A lower end 64 of sprocket shaft 62 may be supported in a bearing cup 66 while and upper end 68 of shaft 62 can protrude through the top wall 12 of the storage container 10. A removable sprocket drive handle 70 is attachable to the upper end 68 of the sprocket shaft 62. Handle 70 can be joined to shaft end 68 by suitable splines. Alternatively, the handle 70 could be provided with a set screw or with a through bore that would align with, and pass through an aperture in the upper end 68 of the sprocket shaft 62. In another configuration, the upper end 68 of the sprocket shaft 62 could carry an enlarged socket into which an end of the handle 70 could be inserted. It would also be possible to form handle 70 as an integral part of shaft 62. A collar 72 could be slidably attached to the sprocket shaft 62 adjacent the upper end 68 of shaft 62 but beneath the container top wall 12 to keep the sprocket shaft 62 in place.

Sprocket 60 is generally disk-shaped and is provided with a plurality of cord-engaging sprocket teeth 74. Sprocket 60 can be attached to shaft 62 in any suitable manner, such as welding or by the provision of spaces collars or the like. As seen in FIGS. 3 and 4, the cord guide tube 52 is provided with an axially extending slot 76 into which a portion of the periphery of sprocket 60 is inserted. In the preferred embodiment, the guide tube slot 76 has a length of 4 inches and a width of ½ inch. The sprocket 52 is sized so that there will be a ⅜-inch gap between its peripheral teeth 74 and an inside wall 78 of the cord guide tube 52. In use, as depicted in FIGS. 2 and 3, a cord 80 will be engaged by the teeth 74 of the sprocket 60 and will contact the inner wall 78 of the cord guide tube 52. As the sprocket 60 is rotated in a clockwise direction as viewed in FIG. 2, the sprocket teeth 74 will engage the surface of the railroad track heating cord 80, which is preferably a synthetic, rope-like material, and will pull the cord 80 through the cord guide tube 52 into the interior of the storage container, generally at 10. As may be seen in FIG. 1, a cord cap 82 is attached by any suitable means, such as a hose clamp or circumferential band clamp to the end of the cord 80. This cord cap 82 may be provided with external screw threads 84 that will engage the internal threads 56 on the outboard end 54 of the cord guide tube 52. Alternatively, if the end 54 of the cord guide tube 52 has external threads, the cord cap 82 will have cooperating internal threads. The cord 80 may be of any suitable material, preferably a material that will absorb or adsorb a sufficient amount of diesel fuel to cause the rail, along which the cord will be laid, to be heated sufficiently, upon combustion of the diesel fuel, so that its ends will come back together. The cord 80 is also preferably re-usable.

In use, as alluded to above, an appropriate amount of a flammable liquid, such as five gallons of diesel fuel, is placed in the storage container 10 by using the fill spout or neck 26. After the liquid has been put into the container 10, the spout cap 28 will be screwed on. A length of cord 80, such as, for example, 125 feet of a synthetic rope, is then placed into the storage container. This is accomplished by inserting a first end of the cord 80 into the cord guide tube 52 from the outboard tube end 54, and by turning the sprocket drive handle 70 to rotate the sprocket 60 in a clockwise direction. The sprocket teeth 74 will engage the cord 80 in the tube 52 and will pull the cord 80 into the diesel fuel 24 in the storage container 10 will cease when the cord cap 82 contacts the outboard end 54 of the cord guide tube 52. At this point, the cord cap 82 can be secured to the end of the guide tube 52 to effectively seat the storage container 10.

In the event of a rail break, the storage container 10 with its cord 80 immersed in diesel fuel 24 can be carried, either by handles 30 and 32, or by lifting chain or straps 34 of the site of the break. The cord cap 82 can be unscrewed, and the cord can be pulled out of the container 10. Removal of the cord 80 can be asserted by rotation of the sprocket 60 in a counterclockwise direction. The cord 80 will be laid along the track, and the storage container 10 can be moved away. No diesel fuel 24 will be spilled during transport of the storage container 10 or during removal of the cord 80. The flammable liquid on the cord can then be ignited to heat the rail sections on either side of the break. After all of the fuel has been burned off the cord 80, and it has cooled, the cord 80 can be returned to the interior of the storage container 10 by actuation of the cord drive sprocket 60 as discussed above. Five gallons of diesel fuel is sufficient to provide several burns using a 125-foot length of synthetic cord 80.

While a preferred embodiment of a storage container for railroad track heating cord in accordance with the present invention has been set forth fully and completely hereinabove, it will be apparent to one of skill in the art that a number of changes in, for example, the overall size and shape of the storage container, the specific type of cord used, the materials used to make the container and the like could be made without depending from the true spirit and scope of the present invention which is accordingly to be limited only by the following claims.

What is claimed is:

1. A storage container for a railroad track heating cord comprising:

a closed container;

means for placing a flammable liquid within said closed container;

a railroad track heating cord guide extending from exterior of said closed container to within said closed container; and a cord drive assembly within said closed container, said cord drive assembly being operable to draw a railroad track heating cord into said container through said cord guide for immersion in the flammable liquid, the railroad track heating cord, after having been immersed in the flammable liquid, being removable from said closed container through said cord guide for placement along a railroad track.

2. The storage container of claim 1 wherein said closed container is a rectangular container having a top, bottom, and side walls.

3. The storage container of claim 2 further including an access plate secured to said top wall of said closed container.

4. The storage container of claim 1 wherein said means for placing a flammable liquid in said closed container includes a liquid fill spout.

5. The storage container of claim 4 further including a spout cap for closure of said liquid fill spout.

6. The storage container of claim 1 including a cord drive assembly enclosure located within said closed container and wherein said cord drive assembly is located within said cord drive assembly enclosure.

7. The storage container of claim 6 wherein said cord drive assembly includes said cord guide and a cord drive sprocket, said cord drive sprocket being rotatable and having a peripheral surface.

8. The storage container of claim 7 wherein said cord guide is a tube and further wherein said cord guide tube includes an axially extending slot, said peripheral surface of said cord drive sprocket being receivable within said slot.

9. The storage container of claim 7 further including a removable drive handle for said cord drive sprocket.

10. The storage container of claim 9 further including an outer end on said cord guide, said cord guide outer end being threaded.

11. The storage container of claim 10 further including a cord cap securable to an end of a railroad heating cord and engageable with said cord guide outer end.

12. The storage container of claim 1 further including handles attached to said closed container.

13. A storage container for a railroad track heating cord comprising:

a closed container;

means for placing a flammable liquid within said closed container;

a cord drive assembly within said closed container, said cord drive assembly being operable to draw a length of a track heating cord into said container for immersion in the flammable liquid; and a cord drive assembly enclosure located within said closed container, said cord drive assembly being located within said drive assembly enclosure.

14. The storage container of claim 13, wherein said cord drive assembly includes a cord guide tube and a cord drive sprocket, said cord drive sprocket being rotatable and having a peripheral surface.

15. The storage container of claim 14, further including an axially extending slot in said cord guide tube, said peripheral surface of said cord drive sprocket being receivable within said slot.

16. The storage container of claim 14, further including a removable drive handle for said cord drive sprocket.

17. The storage container of claim 14, further including an outer end on said guide tube, said cord guide tube outer end being threaded.

18. The storage container of claim 17, further including a cord cap securable to an end of a track heating cord and engageable with said cord guide tube outer end.

* * * * *